US005263413A

United States Patent [19]

Ikeguchi

[11] Patent Number: 5,263,413

[45] Date of Patent: Nov. 23, 1993

[54] METHOD AND SYSTEM FOR SYNCHRONOUSLY PHASE-CONTROLLING PRINTING ROLL DRIVING SYSTEM FOR CORRUGATED BOARD PRINTING PRESS

[75] Inventor: Masao Ikeguchi, Yukuhashi, Japan

[73] Assignees: Kabushiki Kaisha Yaskawa Denki Seisakusho, Kitakyushu; Hamada Printing Press Co., Ltd., Osaka, both of Japan

[21] Appl. No.: 842,190

[22] PCT Filed: Jul. 19, 1991

[86] PCT No.: PCT/JP91/00963

§ 371 Date: Mar. 19, 1992

§ 102(e) Date: Mar. 19, 1992

[87] PCT Pub. No.: WO92/01562

PCT Pub. Date: Feb. 6, 1992

[30] Foreign Application Priority Data

Jul. 20, 1990 [JP] Japan ..... 2-190680

[51] Int. Cl.[5] ..... B41F 5/02

[52] U.S. Cl. ..... 101/183; 101/486

[58] Field of Search ..... 101/248, 181, 228, 219, 101/484, 488, 486; 318/49, 85, 68, 69, 77, 51, 41, 721, 715, 799, 806; 226/42, 2, 28, 29, 30, 31; 493/34, 30, 321, 13-15, 324

[56] References Cited

U.S. PATENT DOCUMENTS 4,527,788 7/1985 Masuda ..... 101/248

FOREIGN PATENT DOCUMENTS 55-71188 5/1980 Japan .

60-250955 12/1985 Japan .

*Primary Examiner*—J. Reed Fisher

*Attorney, Agent, or Firm*—Oblon, Spivak, McClelland, Maier & Neustadt

[57] ABSTRACT

The present invention belongs to the technical field of synchronously controlling the phase relationship between a plurality of printing rolls in a corrugated board printing press. The object of this invention is to realize synchronous phase control at low cost and with high precision by software. In this invention, a speed command inputted is converted to a digital value at regular intervals to integrate the digital value, the revolution speed of each of the printing rolls is also integrated, and any deviation between these integrated values is subjected to PI operation, thereby separately correcting the revolution speed commands given to drive motors on the basis of their corresponding results of the PI operation. At this time, when the results of the operation in the course of the integrating the speed command and the individual printing rolls exceed the highest value, their values separately return to 0 to continue the operation.

7 Claims, 4 Drawing Sheets

METHOD AND SYSTEM FOR SYNCHRONOUSLY PHASE-CONTROLLING PRINTING ROLL DRIVING SYSTEM FOR CORRUGATED BOARD PRINTING PRESS

TECHNICAL FIELD

This invention relates to a method for controlling printing rolls in a corrugated board printing press and a system thereof, and specifically to a method of synchronously phase-controlling a printing roll driving system for a corrugated board printing press having a plurality of printing rolls in order to maintain a phase relationship between the printing rolls in a preset state, and a system thereof.

BACKGROUND ART

A corrugated board printing press is provided with a plurality of printing rolls to realize multi color printing. In order to avoid disadvantages such as misregistration, these printing rolls must be driven so as to synchronize their phases with each other. In order to maintain the phase relationship between these rolls unchanged, they have heretofore been coupled and interlocked with each other through a transmission such as belts and/or gears so as to be driven from a single motor having a variable speed and a large capacity. This arrangement however requires breaking the interlocking relation between the printing rolls when replacing plate cylinders installed on the printing rolls or maintaining the printing press and then recoupling them together into an operable state. This recoupling requires a great deal of work so that the gears are properly re-engaged with each other in order to keep the phase relationship between the printing rolls synchronous.

U.S. Pat. No. 4,527,788 to Masuda, filed on Aug. 1, 1984, discloses a printing press making use of a sectional servodrive method to overcome the above-described disadvantages. This apparatus comprises, on each printing roll, a DC drive motor having a variable speed, a zero point sensor for detecting a zero point marked on the roll to determine the revolution angle of the roll, a tachometer generator for detecting the speed of the DC drive motor and a pulse generator for generating pulses at a preset rate per predetermined revolution angle of the DC drive motor. First, the initial phase for each roll is determined by the zero point sensor to set it to a desired value. A speed command common to the individual DC drive motors is converted by a V/F converter to a reference pulse signal. This reference pulse signal is integrated and compared with an integrated pulse signal from the pulse generator, thereby determining a deviation. This deviation corresponds to the difference between the ideal and actual phases of the printing roll. Using an analog computer, the F/V-converted reference pulse signal is compared with the revolution speed of the DC drive motor to determine a servo-controlling value. Further, the level of servo-controlling is adjusted according to the degree of the phase deviation, whereby the DC drive motor is servo-controlled.

In FIG. 4 is shown an illustrative system obtained by further improving on the system disclosed in U.S. Pat. No. 4,527,788. FIG. 4 is a block diagram illustrating the construction of a synchronous phase-control system for printing rolls in a corrugated board printing press having, for example, 3 printing rolls.

Three printing rolls $\mathbf{1}_1$, $\mathbf{1}_2$, and $\mathbf{1}_3$ are driven by servomotors $\mathbf{13}_1$, $\mathbf{13}_2$ and $\mathbf{13}_3$, respectively. Pulse encoders $\mathbf{14}_1$, $\mathbf{14}_2$ and $\mathbf{14}_3$ respectively connected to servomotors $\mathbf{13}_1$, $\mathbf{13}_2$ and $\mathbf{13}_3$ output positional feedback pulse signals $\mathbf{10}_1$, $\mathbf{10}_2$ and $\mathbf{10}_3$, respectively, according to the revolution of their corresponding servomotors $\mathbf{13}_1$, $\mathbf{13}_2$ and $\mathbf{13}_3$. Positional feedback pulse signals $\mathbf{10}_1$, $\mathbf{10}_2$ and $\mathbf{10}_3$ are inputted as feedback $N_{FB}$ in respective servo-drivers $\mathbf{12}_1$, $\mathbf{12}_2$ and $\mathbf{12}_3$ through their corresponding F/V converters 8 and at the same time, also in their corresponding deviation counters 5. The term "synchronous phase-control" as used herein means that in this apparatus of the sectional servodrive system, the phase relationship between the rotors of the individual servomotors at the beginning of operation is kept unchanged during operation.

For this purpose, reference positional command pulse signal 9 is generated by pulse generator 3 according to speed command $v_{ref}$ inputted from speed setter 2. Any deviation between this signal and positional feed back pulse signal $\mathbf{10}_1$ is detected by deviation counter 5 and outputted as positional deviation signal 15. Deviation counter 5 comprises phase pulse counter 5*a*, pulse computing circuit 5*b* and reference pulse counter 5*c* and is conventionally known. After positional deviation signal 15 is D/A-converted by D/A converter 6, the gain of the analog signal thus converted is adjusted by analog regulator 7. The analog signal thus adjusted is added to an analog speed command converted from reference positional command pulse signal through F/V converter 4. The sum is given as revolution speed command 11 for servomotor $\mathbf{13}_1$ to servodriver $\mathbf{12}_1$, whereby servodriver $\mathbf{12}_1$ serves to drive servomotor $\mathbf{13}_1$. To other servomotors $\mathbf{13}_2$ and $\mathbf{13}_3$, respective revolution speed commands $\mathbf{11}_2$ and $\mathbf{11}_3$ are also given by control units similar to that described above, so that each of servomotors $\mathbf{13}_1$ to $\mathbf{13}_3$ is synchronously phase-controlled in such a manner that the deviation of the actual revolution from the positional command generated by common speed command $v_{ref}$ becomes zero.

DISCLOSURE OF INVENTION

The above-described conventional synchronous phase control system according to the sectional servodrive method in the printing press for corrugated boards requires hardware such as a pulse train generator, an F/V converter and an operational amplifier in order to form a reference positional command. With recent development in microprocessors, attempts to realize various kinds of control equipment by software, which were heretofore actualized by hardware, have been made in various places. However, it has been unfeasible to date to make up the synchronous phase control systems described above of software for the following reasons. Pulses which represent the movement of the printing rolls must be integrated continuously because their movement is rotary, and it is hence impossible to avoid problems of overflow of the numeric value, and of numerical expression (for example, according to the numerical expression in a controller conventionally used in the system of this kind, the negative maximum value appears next to the positive maximum value), among others. Moreover, controllers having a CPU, which permits high-speed computing processes, are rarely available.

In view of the foregoing circumstances, the present invention has been made and is intended to realize the synchronous phase control of printing rolls in a corrugated board printing press by making use of software in place of hardware. In other words, an object of this invention is to provide a method of synchronously phase-controlling a printing roll drive system for a corrugated board printing press by making use of software, said method being high in precision and permitting an increase in the number of rolls without a substantial increase in cost, and a system suitable for use in performing this method.

According to the present invention, there is thus provided a method of synchronously phase-controlling a printing roll drive system for a corrugated board printing press, which comprises converting a common speed command inputted in each of the printing rolls to its corresponding internal speed command, forming a positional feedback pulse signal by a pulse encoder connected to its corresponding printing roll, detecting and integrating the internal speed command at regular intervals to multiply a predetermined coefficient by the integrated value each time, thereby forming a reference positional command, said reference positional command returning to 0 after it comes to the highest value of the operation to continue the integration, integrating the positional feedback pulse signal to form a feedback position signal, said feedback position signal returning to 0 after it comes to the highest value of the operation to continue the integration, and then subjecting any deviation between the reference positional command and the feedback position signal to PI operation to add its result to the speed command, thereby regarding the sum as a revolution speed command to the corresponding printing roll to drive the corresponding printing roll according to the revolution speed command.

According to this invention, there is also provided a system for synchronously phase-controlling a printing roll drive system for a corrugated board printing press, which comprises a controller having a reference positional command generating circuit for converting a common speed command inputted in each of the printing rolls to its corresponding internal speed command, detecting and integrating the internal speed command at regular intervals to multiply a predetermined coefficient by the integrated value each time, thereby forming a reference positional command, said reference positional command returning to 0 after it comes to the highest value of the operation to continue the integration, feedback position signal forming means for separately counting and integrating positional feedback pulse signals of the printing rolls to form their corresponding feedback position signals, each of said feedback position signals returning to 0 after it comes to the highest value of the operation to continue the integration, and PI-operating means for separately subjecting deviations between the reference positional commands and the feedback position signals in the printing rolls to PI operation to add their results to their corresponding internal speed commands and outputting the sums as a revolution speed command in their corresponding servo-controllers.

In other words, in this invention a speed command inputted is detected and integrated at regular intervals to multiply a predetermined coefficient by the integrated value each time, thereby forming a reference positional command moment by moment. This reference positional command returns to 0 after it comes to the highest value of the operation to continue the operation. These operation processes can be executed by means of a controller realized by a CPU. How the above-mentioned reference positional command is formed will hereinafter be described with reference to FIGS. 2(*a*) and 2(*b*).

Supposing that an internal speed command corresponding to an inputted speed command $v_{ref}$, a reference positional command and a predetermined coefficient are $V_{REF}$, $X_{REF}$ and A, respectively, the operation process by the CPU is expressed by:

$$X_{REF} = A \cdot \sum_n V_{REF}(n)$$

wherein $V_{REF}(n)$ is internal speed command $V_{REF}$ detected nth detection.

Supposing that an interval to be detected ($T_S$), the feedback pulse signal (FBPPR), the speed (100%) of the servomotor and the internal speed command (100%) of the controller are the following values:

$T_S$: 4 msec
FBPPR: 6,000 P/R
speed (100%): 1,500 RPM
internal speed command (100%): 10,000, the frequency of the feedback pulse signal at the maximum speed (100%) is as follows:

$$\frac{1{,}500 \text{ RPM}}{60} \cdot 6000 \text{ P/R} = 150{,}000 \text{ pps.}$$

Therefore, the number of feedback pulses per $T_S$ is as follows:

$$150{,}000 \text{ pps} \cdot 4 \cdot 10^{-3} \text{ sec} = 600 \text{ p.}$$

Accordingly, the following relationship is satisfied:

$$A \cdot 10{,}000 = 600$$
$$\therefore A = \frac{6}{100}$$

This relationship is generalized by supposing that the 100% speed is Nr (RPM), the feedback pulse signal is FBPPR (P/R) and the interval to be detected is $T_S$ (msec) to find the following result:

$$A = \frac{Nr}{60} \cdot FBPPR \cdot T_S \cdot 10^{-3} \cdot \frac{1}{10000} = \frac{Nr \cdot FBPPR \cdot T_S}{60000} \cdot \frac{1}{10000}$$

In other words, the coefficient A is the coefficient by which the commanded integrated revolution speed for each printing roll, which is expressed in terms of the integrated internal speed command, is coordinated with the actual integrated revolution speed of the printing roll, which is expressed in terms of the feedback position signal.

FIG. 2(*a*) illustrates the condition of changes in internal speed command $V_{REF}$ with time. The area of region S indicated by oblique lines in the drawing shows integrated value $$\left[\sum_n V_{REF}(n)\right]$$

of internal speed command $V_{REF}$. Area R indicated by cross oblique lines corresponds to feedback pulses for 1 $T_S$ (600 pulses in the case of the above-described calculation). In addition, FIG. 2(*b*) illustrates the condition in which the increment in reference positional command $X_{REF}$ operated at every interval $T_S$ is integrated serially.

Similarly, positional feedback pulses fed back from a pulse encoder connected to each printing roll are integrated at the regular intervals described above to form a feedback position signal moment by moment. This feedback position signal returns to 0 after it comes to the highest value of the operation to continue the operation. As described above, numerical continuity upon integration is given to the controller, whereby in the operation as to any deviation between the reference positional command and the feedback position signal, continuity of operation can be achieved even in the vicinity of the upper limit or 0 of the register used. Therefore, this deviation is subjected to PI operation and then added to the speed command to control the revolution speed of a drive motor through a servodriver in such a manner that the deviation becomes 0. At this time, it is convenient to carry out not only P (proportional) control proportional to the deviation but also I (integral) control, because an operational output corresponding to torque required upon acceleration or deceleration of the speed can be obtained. The above-described control making use of the common speed command to all the drive motors permits the realization of synchronous phase control. In addition, the execution of the whole operation by the CPU permits the provision of a system which is both reliable in operation and inexpensive.

BEST MODE OF CARRYING OUT THE INVENTION

Embodiments according to the present invention will hereinafter be described with reference to the drawings.

Figure 1:
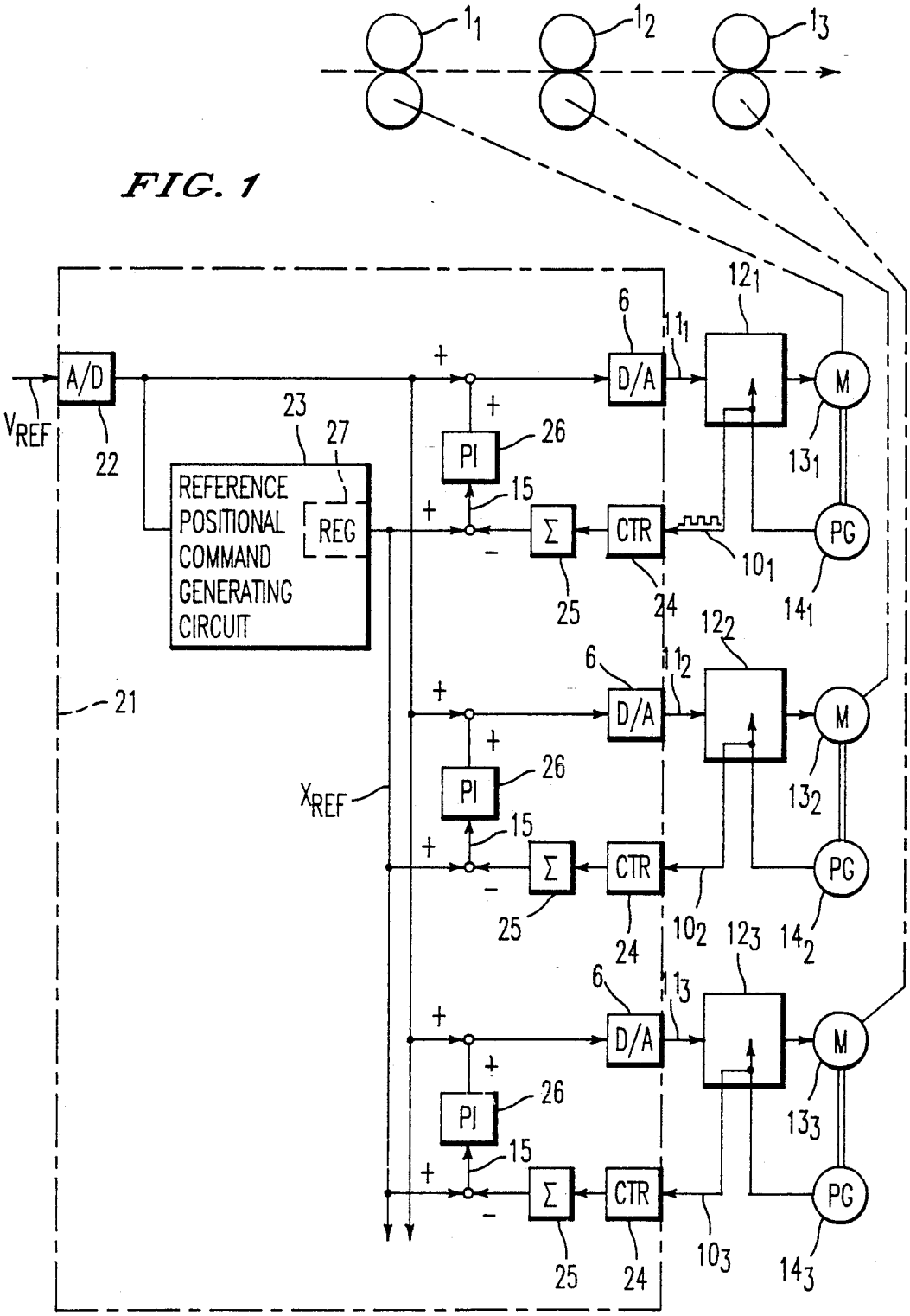
FIG. 1 is a block diagram illustrating the constitution of a synchronous phase control system of a servo system according to an embodiment of this invention.
Figure 2A:
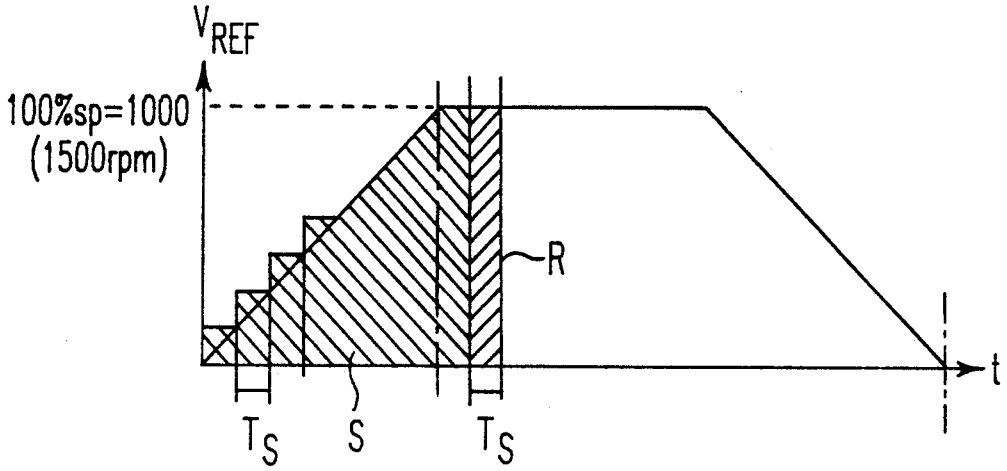
FIG. 2(*a*) is a characteristic diagram illustrating changes in internal speed command $V_{REF}$, and FIG. 2(*b*) is a characteristic diagram illustrating formation of reference positional command $X_{REF}$.
Figure 2B:
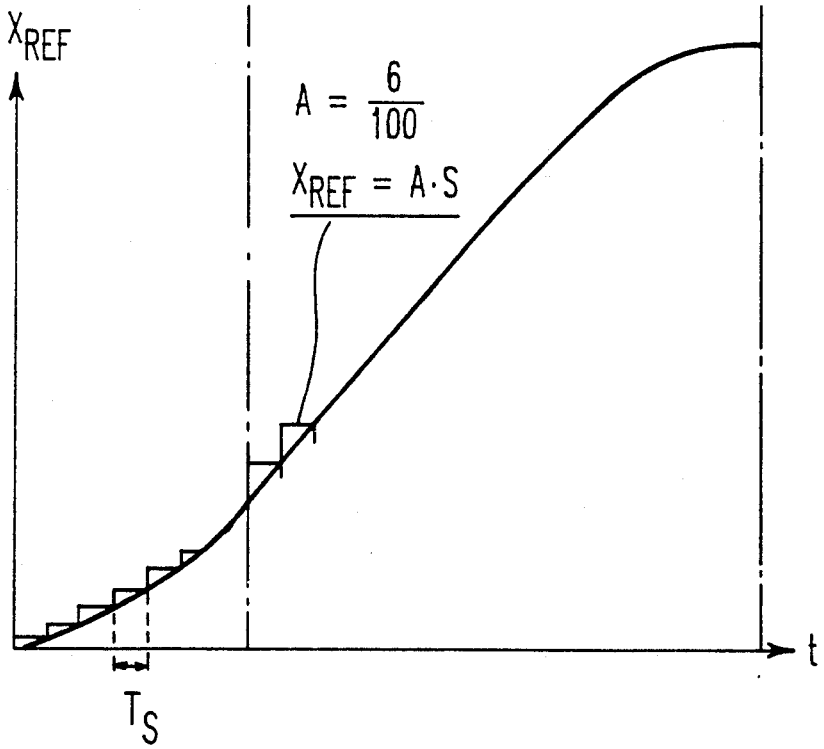

FIG. 1 is a block diagram illustrating the constitution of a synchronous phase control system making use of a method for synchronously phase-controlling a printing roll driving system for a corrugated board printing press according to an embodiment of this invention.

Figure 4:
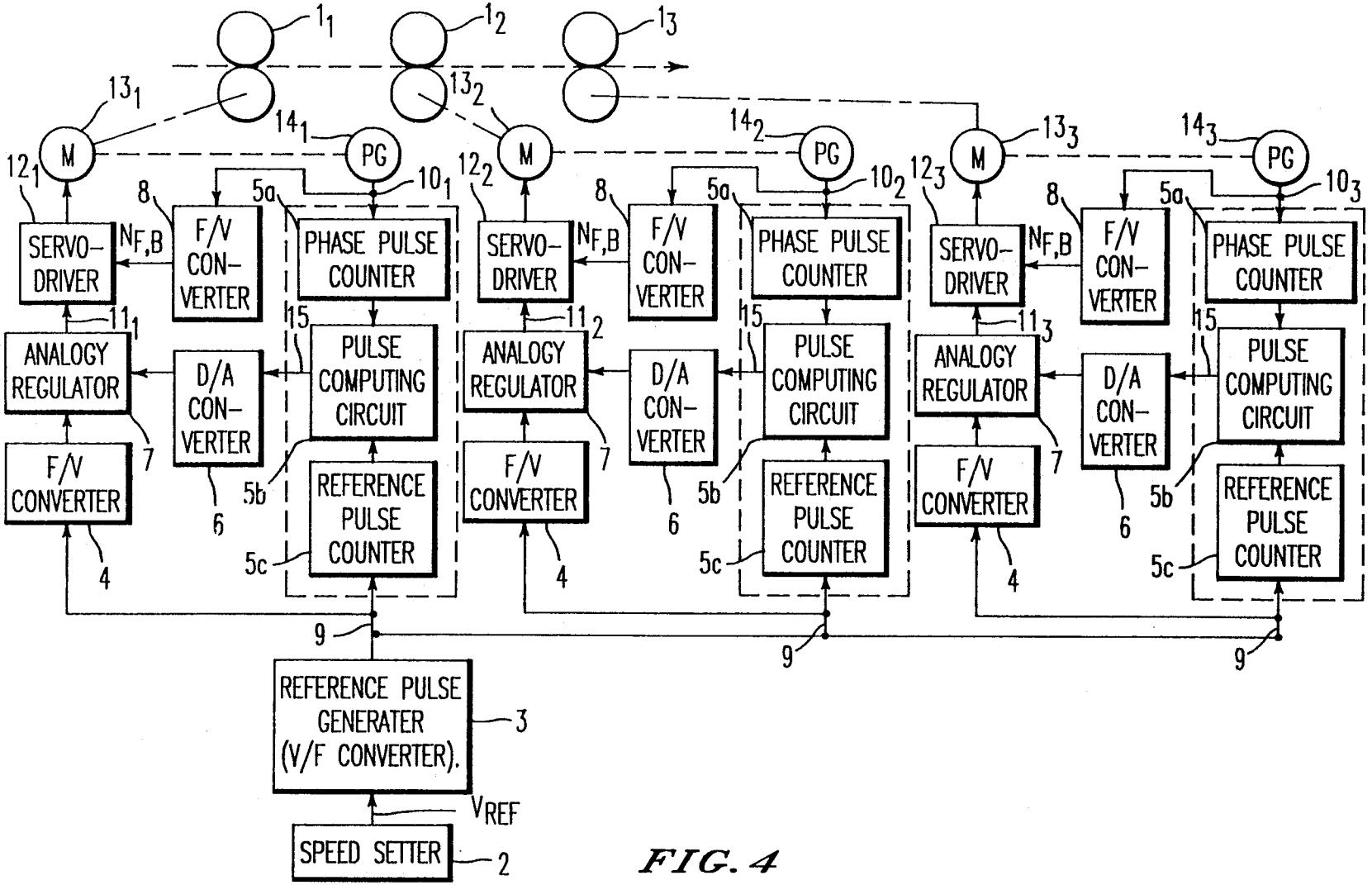
FIG. 4 is a block diagram illustrating the constitution of a conventional synchronous phase control system for printing rolls in a corrugated board printing press having, for example, 3 printing rolls.

In this embodiment, a series of hardware ranging from pulse train generator 3 to adding operational amplifiers 8, which have been used in the prior art described above with reference to FIG. 4, are replaced by controller 21 composed of a CPU. In FIG. 1, controller 21 is represented by a circuit diagram as a matter of convenience for the purpose of explaining the contents of operation executed by controller 21.

Three printing rolls $\mathbf{1}_1$, $\mathbf{1}_2$ and $\mathbf{1}_3$ are connected to driving servomotors $\mathbf{13}_1$, $\mathbf{13}_2$ and $\mathbf{13}_3$, respectively. Servomotors $\mathbf{13}_1$, $\mathbf{13}_2$ and $\mathbf{13}_3$ are respectively driven through servodrivers $\mathbf{12}_1$, $\mathbf{12}_2$ and $\mathbf{12}_3$ and directly connected to pulse encoders $\mathbf{14}_1$, $\mathbf{14}_2$ and $\mathbf{14}_3$ These pulse encoders $\mathbf{14}_1$, $\mathbf{14}_2$ and $\mathbf{14}_3$ are adapted to generate respective positional feedback pulses $\mathbf{10}_1$, $\mathbf{10}_2$ and $\mathbf{10}_3$ whenever servomotors $\mathbf{13}_1$, $\mathbf{13}_2$ and $\mathbf{13}_3$ rotate by a predetermined angle, i.e., whenever printing rolls $\mathbf{1}_1$, $\mathbf{1}_2$ and $\mathbf{1}_3$ rotate by the predetermined angle.

Controller 21 comprises A/D converter 22 and reference positional command generating circuit 23, which are commonly provided for printing rolls $\mathbf{1}_1$, $\mathbf{1}_2$ and $\mathbf{1}_3$, and D/A converters 6, counters 24, positional feedback pulse generating circuits 25 and PI computing circuits 26, which are separately provided on each of printing rolls $\mathbf{1}_1$, $\mathbf{1}_2$ and $\mathbf{1}_3$. A/D converter 22 is adapted to convert speed command $v_{ref}$, which is an analog signal fed from the outside for indicating the revolution speed of each of printing rolls $\mathbf{1}_1$, $\mathbf{1}_2$ and $\mathbf{1}_3$, to internal speed command $V_{REF}$, which is a digital signal used in controller 21. Internal speed command $V_{REF}$ is inputted in reference position command generating circuit 23, and then for each of printing rolls $\mathbf{1}_1$, $\mathbf{1}_2$ and $\mathbf{1}_3$, added to an output from its corresponding PI computing circuit 26, which will be described subsequently, to be inputted in its corresponding D/A converter 6. Each of D/A converters 6 D/A-converts the input signal to a revolution speed command $\mathbf{11}_1$, $\mathbf{11}_2$ or $\mathbf{11}_3$ inputted in its corresponding servodriver $\mathbf{12}_1$, $\mathbf{12}_2$ or $\mathbf{12}_3$.

Reference positional command generating circuit 23 contains register 27 having a predetermined bit length therein, and is adapted to detect and integrate internal speed command $V_{REF}$ at regular intervals, store a product obtained by multiplying the above-described coefficient A by this integrated value in register 27 and output the data stored in register 27 as reference positional command $X_{REF}$. In this case, after reference positional command $X_{REF}$ comes to the highest value depending upon the bit length of register 27, the value of (the highest value + 1) is regarded as 0 to continue the integration. In other words, integration in this register 27 is executed without consideration for the so-called sign bit and in disregard of overflow.

On the other hand, counters 24 in which their corresponding positional feedback pulses $\mathbf{10}_1$, $\mathbf{10}_2$ and $\mathbf{10}_3$ are inputted through respective servodrivers $\mathbf{12}_1$, $\mathbf{12}_2$ and $\mathbf{12}_3$ and are adapted to count positional feedback pulses $\mathbf{10}_1$, $\mathbf{10}_2$ and $\mathbf{10}_3$ at the same intervals as the integration in reference positional command generating circuit 23 and to send the counts to their corresponding positional feedback pulse integrating circuits 25. Positional feedback pulse integrating circuits 25 each have the same bit length a that of register 27 and are adapted to integrate their corresponding counts of positional feedback pulses $\mathbf{10}_1$, $\mathbf{10}_2$ and $\mathbf{10}_3$ at the same intervals as the integration in reference positional command generating circuit 23. In this integration as well, after the integrated value comes to the highest value depending upon the bit length of feedback pulse integrating circuit 25, the value of (the highest value + 1) is regarded as 0 to continue the integration, as in the case of reference positional command $X_{REF}$. Regarding this integrated value, its deviation 15 from reference positional command $X_{REF}$ is found. Deviation 15 is inputted in its corresponding PI computing circuit 26. As described below, the calculation for finding deviation 15 is executed with consideration for the so-called sign bit so as to be able to process positive and negative numbers. PI computing circuits 26 are those well known in the art for performing PI (proportional plus integral) control.

The computing operation of this system will hereinafter be described.

A speed command $V_{ref}$ inputted for indicating the revolution speed of printing rolls $1_1$, $1_2$ and $1_3$ is converted to corresponding internal speed command $V_{REF}$ by A/D converter 22 and inputted in reference positional command generating circuit 23. This internal speed command $V_{REF}$ is used as a reference of the speed upon driving servomotors $13_1$, $13_2$ and $13_3$. Reference positional command generating circuit 23 serves to detect the internal speed command $V_{REF}$ inputted at regular intervals, integrate it serially to multiply the above-described coefficient A by this integrated value, and then store the product each time in register 27 to output it as reference positional command $X_{REF}$. In this case, as described above, reference positional command $X_{REF}$ returns to 0 after it comes to the highest value to continue the integration. Therefore, reference positional command $X_{REF}$ always represents a fraction where an integrated revolution angle determined for each of printing rolls $1_1$, $1_2$ and $1_3$ is divided by a fixed number. This fixed number is a value corresponding to the bit length of register 27.

On the other hand, positional feedback pulses $10_1$, $10_2$ or $10_3$ from pulse encoders $14_1$, $14_2$ or $14_3$ are counted by its corresponding counter 24. This count is integrated in positional feedback pulse integrating circuit 25 at the same intervals as to the case of the detection of internal speed command $V_{REF}$ described above. This integrated value is a feedback position signal, which represents a fraction where the actual integrated revolution angle of each of printing rolls $1_1$, $1_2$ and $1_3$ is divided by a fixed number. This fixed number is the same as that in the case of reference positional command $X_{REF}$ described above. Any deviation between the feedback position signal and reference positional command $X_{REF}$ represents the difference between the actual revolution angle of its corresponding printing roll $1_1$, $1_2$ or $1_3$ and the revolution angle based on the speed command at that point of time. Therefore, the speed to be commanded to its corresponding servomotor $13_1$, $13_2$ or $13_3$ will be accelerated or decelerated by a degree corresponding to the deviation of the revolution angle by executing PI operation in PI computing circuit 26 on the basis of this deviation and adding the result to internal speed command $V_{REF}$.

Internal speed command $V_{REF}$ added to the result of the PI operation is D/A-converted by D/A converter 6 to revolution speed command $11_1$, $11_2$ or $11_3$, which is to be outputted to its corresponding servodriver $12_1$, $12_2$ or $12_3$. Servodriver $12_1$, $12_2$ or $12_3$ serves to drive its corresponding servomotor $13_1$, $13_2$ or $13_3$ according to revolution speed command $11_1$, $11_2$ or $11_3$. Servomotor $13_1$, $13_2$ or $13_3$ is driven according to a command obtained by using common internal speed command $V_{REF}$ as a reference and correcting common internal speed command $V_{REF}$ on the basis of the deviation between its corresponding feedback position signal and reference positional command $X_{REF}$. Therefore, servomotor $13_1$, $13_2$ and $13_3$ are driven so that their phases will synchronize with one another according to speed command $v_{ref}$.

Figure 3:
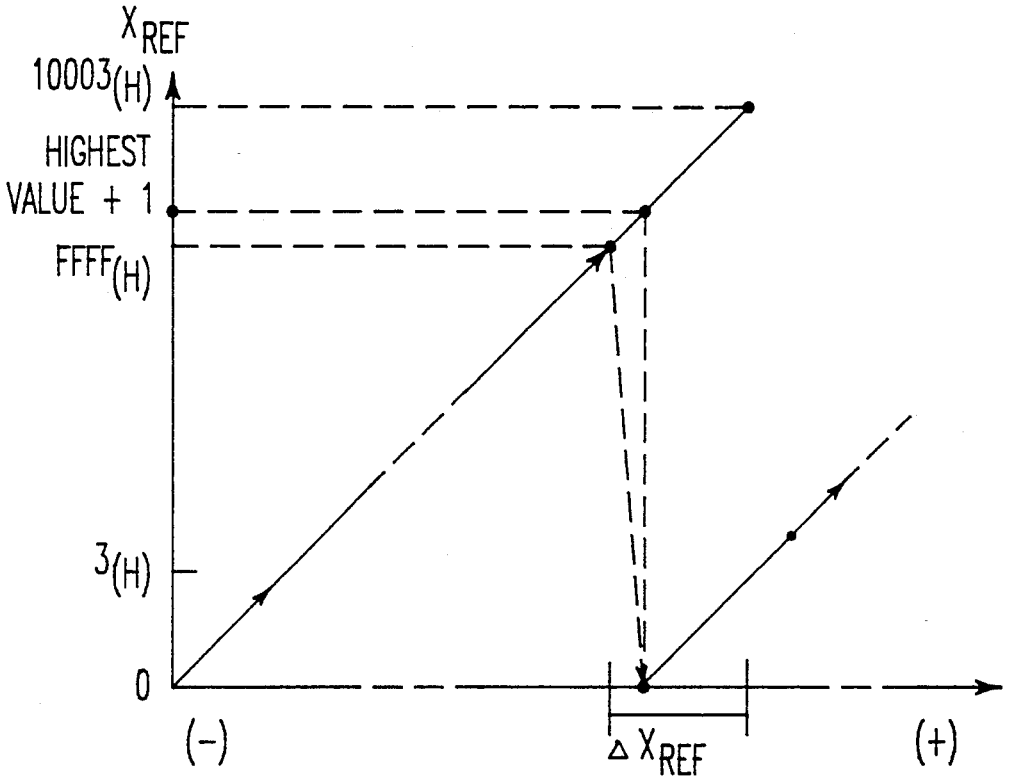
FIG. 3 is a characteristic diagram illustrating how to integrate both reference positional command $X_{REF}$ and a feedback position signal.

Here, how to find the deviation between the feedback position signal and reference positional command $X_{REF}$ will be described. As described above, the feedback position signal and reference positional command $X_{REF}$ have the same bit length and are integrated by regarding values, (the highest value+1), of respective positional feedback pulse generating circuit 25 and register 27 as 0 upon their integration. The description will hereinafter be given about reference positional command $X_{REF}$ by considering the bit length to be 16 bits. It goes without saying that this applies exactly to the case of the feedback position signal. This integration does not take the sign bits into consideration as described above, and is hence processed as so-called unsigned integer operation. The highest value expressed as a number is 65535 ($=2^{16}-1$). Here, if hexadecimal notation is expressed in $_{(H)}$, the highest value, 65535, is $FFFF_{(H)}$. In addition, the internal expression in both positional feedback pulse generating circuit 25 and register 27 is $FFFF_{(H)}$. For example, $4_{(H)}$ as a new value to be integrated, $\Delta X_{REF}$, is integrated to this number, resulting in $FFFF_{(H)}+4_{(H)}=10003_{(H)}$ as illustrated in FIG. 3. Since (the highest value+1) is regarded as 0, however, it makes $3_{(H)}$.

In the deviation on the other hand, the computation is made by so-called signed integer operation in which positive and negative numbers are distinguished from each other as described above. The signed integer operation is an operation wherein if the most significant bit is 0, the value represents a positive number, while if the most significant bit is 1, the value represents a negative number. The reason why this operation is used is that neither the feedback position signal nor reference positional command $X_{REF}$ becomes negative, whereas the deviation can have either positive and negative values. The deviation is obtained by subtracting the feedback position signal from reference positional command $X_{REF}$. For example, when reference positional command $X_{REF}$ and the feedback position signal are $FFFF_{(H)}$ and $3_{(H)}$, respectively, the deviation is to be $-4_{(H)}$ from the above description. Subtracting $3_{(H)}$ from $FFFF_{(H)}$ leaves $FFFC_{(H)}$ in terms of the internal expression. This means 65532 in the unsigned operation and $-4(=-4_{(H)})$ in the signed operation. It is to be understood that a positive or negative deviation can be found exactly in a range of numbers (if 16 bits, from −32768 to +32767), which are represented by the bit length where the most significant bit is made a sign bit, by executing the signed operation.

The bit lengths of the feedback position signal and reference positional command $X_{REF}$ will hereinafter be described. Controller 21 shown in this embodiment usually consists of a CPU. CPUs are usually constructed so as to permit the operation of 8, 16 or 32 bits, or even longer bits. If 16 bits are made single-length data and 32 bits double-length data, it is possible to process numbers in a range of from −32768 to +32767 for the single-length data and from −2147483648 to +2147483647 for the double-length data. If the number of positional feedback pulses per revolution of each of printing rolls $1_1$, $1_2$ and $1_3$ is made greater in order to enhance the resolution of the system, the value of the deviation in the single-length data may momentarily depart from the above range when a great load change occurs. For example, in U.S. Pat. No. 4,527,788 cited above, there is a description to the effect that 15,000 pulses per revolution of the drive motor are generated. Such a departure of the deviation from the range may cause an operation error, so that the synchronous phase relationship between printing rolls $1_1$, $1_2$ and $1_3$ may be discontinued, resulting in unavoidable stop of the printing press. Further, since the data in the course of operation must fall within the range of the data length, it is desirable that the bit lengths of the feedback position signal and reference position signal $X_{REF}$, i.e., the bit lengths of positional feedback pulse generating circuit 25 and register 27, are made 32 bits (double-length data) or more.

In the above description, the progress of the operation has been explained as represented by the circuit diagram illustrated in FIG. 1 as a matter of convenience. In reality, the whole operation is however executed according to a program stored in controller 21 (CPU).

INDUSTRIAL APPLICABILITY

As described above, the present invention brings about the following effects. Since the whole operation is executed by means of a CPU which is a controller capable of carrying out the processes to maintain numerical continuity upon integration, the mere application of a speed command to the controller from the outside permits synchronous phase control, and no hardware incident to the outside is required. In addition, since all the processes are carried out by digital software, it is also possible to use double-length data. It is hence possible to synchronously phase-control the printing roll drive systems for corrugated board printing presses with high precision and without a substantial increase in cost even when the number of drive shafts to be controlled is increased.

I claim:

1. A method of synchronously phase-controlling a printing roll drive system for a corrugated board printing press having plurality of printing rolls and pulse encoders in order to maintain a phase relationship between the printing rolls in a preset state, each of the pulse encoders being connected to a corresponding one of the printing rolls, which comprises:

converting a common speed command inputted in each of the printing rolls to an internal speed command value which is used in said system in place of the common speed command;

forming a positional feedback pulse signal by the pulse encoder connected to its corresponding printing roll;

detecting and integrating the internal speed command value at regular intervals to multiply a predetermined coefficient by the integrated value each time, thereby forming a reference positional command value, said reference positional command value returning to 0 after it comes to the highest value of an arithmetic operation to continue the integration;

integrating the positional feedback pulse signal to form a feedback position signal value, said feedback position signal value returning to 0 after it comes to the highest value of the arithmetic operation to continue the integration; and then subjecting any deviation between the reference positional command value and the feedback position signal value to proportional plus integration control operation to add its result to the internal speed command value, thereby regarding the sum as a revolution speed command to the corresponding printing roll to drive the corresponding printing roll according to the revolution speed command.

2. A method as claimed in claim 1, wherein each of the internal speed command value, reference positional value and feedback position signal value is represented as a digital value.

3. A method as claimed in claim 2, wherein each of the internal speed command value, reference positional value and feedback position signal value is represented by a same bit width.

4. A system for synchronously phase-controlling a printing roll drive system for a corrugated board printing press having a plurality of printing rolls in order to maintain a phase relationship between the printing rolls in a preset state, said printing roll drive system comprising drive motors which are separately connected to the printing rolls, pulse encoders which are separately connected to the printing rolls and which generate a positional feedback pulse signal, and servodrivers which are separately provided on the drive motors and which serve to drive their corresponding drive motors, which comprises:

a controller having a reference positional command generating circuit for converting a common speed command inputted in each of the printing rolls to an internal speed command value which is used in said system in place of the common speed command, detecting and integrating the internal speed command value at regular intervals to multiply a predetermined coefficient by the integrated value each time, thereby forming a reference positional command value, said reference positional command value being used as an internal positional reference of the printing rolls and returning to 0 after it comes to the highest value of an arithmetic operation to continue the integration; feedback position signal forming means for separately counting and integrating positional feedback pulses of the printing rolls to form their corresponding feedback position signal values, each of said feedback position signal values returning to 0 after it comes to the highest value of the arithmetic operation to continue the integration; and operating means for separately subjecting deviations between the reference positional command values and the feedback position signal values in the printing rolls to proportional plus integral control operation to add their results to their corresponding internal speed command values and outputting the sums as a revolution speed command in their corresponding servodrivers.

5. A system as claimed in claim 4, wherein said controller comprises a CPU.

6. A system as claimed in claim 4, wherein each of the internal speed command value, reference positional value and feedback position signal value is represented as a digital value.

7. A system as claimed in claim 6, wherein each of the internal speed command value, reference positional value and feedback position signal value is represented by a same bit width.

* * * * *